US008708601B2

(12) United States Patent
Elliott

(10) Patent No.: US 8,708,601 B2
(45) Date of Patent: Apr. 29, 2014

(54) BOX CULVERT

(75) Inventor: Thomas Elliott, Reno, NV (US)

(73) Assignee: Jensen Enterprises, Inc., Sparks, NV (US)

( * ) Notice: Subject to any disclaimer, the term of this patent is extended or adjusted under 35 U.S.C. 154(b) by 152 days.

(21) Appl. No.: 13/027,140

(22) Filed: Feb. 14, 2011

(65) Prior Publication Data

US 2011/0255922 A1 Oct. 20, 2011

Related U.S. Application Data

(60) Provisional application No. 61/338,248, filed on Feb. 16, 2010.

(51) Int. Cl.
*F16L 9/22* (2006.01)

(52) U.S. Cl.
USPC ..... 405/126

(58) Field of Classification Search
USPC ..... 405/124–126; 52/604, 590.2, 592.1, 52/588.1; 285/330, 913, 118, 283
See application file for complete search history.

(56) References Cited

U.S. PATENT DOCUMENTS 710,725 A * 10/1902 Stephens et al. ..... 285/330
739,686 A 9/1903 Krupp
887,284 A 5/1908 Stoffer
1,082,723 A 12/1913 Allen et al.
1,130,508 A * 3/1915 Hall ..... 405/125
1,184,634 A 5/1916 Duerrwachter
1,363,056 A * 12/1920 Riedl ..... 138/159
1,639,999 A 8/1927 Humphreys
2,716,864 A 8/1951 Hacker
5,169,161 A * 12/1992 Jones ..... 277/615
5,213,438 A * 5/1993 Barenwald ..... 404/2
5,876,072 A 3/1999 Bross et al.
6,164,618 A * 12/2000 Yonemura ..... 249/35
6,827,326 B2 * 12/2004 Giri ..... 249/165
7,137,756 B1 * 11/2006 Jones ..... 405/126
7,344,335 B2 * 3/2008 Burkhart ..... 405/36
7,530,764 B1 5/2009 Gallegos
2004/0187424 A1 * 9/2004 Wang ..... 52/592.1

FOREIGN PATENT DOCUMENTS

GB 2296304 6/1996

* cited by examiner

*Primary Examiner* — Thomas B Will
*Assistant Examiner* — Jessica H Lutz
(74) *Attorney, Agent, or Firm* — Knobbe, Martens, Olson & Bear LLP

(57) ABSTRACT

A box culvert assembly and method of forming a box culvert assembly is provided. The boxes forming the assembly comprise portions configured to allow pivoted assembly of one box into another, while reducing the likelihood of high stress or fracture. The box assembly further allows for a generally tight seal between the boxes.

9 Claims, 5 Drawing Sheets

BOX CULVERT

CLAIM OF PRIORITY

This application claims benefit under 35 U.S.C. §119(e) to U.S. Provisional Patent Application No. 61/338,248, filed Feb. 16, 2010, which is incorporated in its entirety by reference herein.

BACKGROUND OF THE INVENTION

1. Field of the Invention

This application relates to improved box culverts, box culvert assemblies, and methods of using box culverts.

2. Description of the Related Art

Box culverts are commonly used in the construction and/or road maintenance industry to form culverts. Typically, box culverts comprise box-like concrete structures with openings extending entirely through their central portions. Two or more boxes are generally arranged under the roadway in abutted, linear fashion, with the openings facing one another so as to form one long opening under the roadway. The boxes are typically pushed, or abutted up against one another, until a line of boxes has been formed with an opening extending through them.

Once assembled, the boxes can be used for directing water, mud, debris, etc. from one side of the road to another, thereby inhibiting the accumulation of water, mud, or debris on the roadway itself. The boxes are generally pushed tight enough together so as to form a sealed line of boxes which inhibit leakage of water or debris outside of the culvert.

SUMMARY OF THE INVENTION

An aspect of at least one of the embodiments disclosed herein includes the realization that during assembly of two or more boxes, it is desired to place each box in close and/or sealed contact with another box, without allowing excess mud, debris, or other material to come between the two boxes. Pushing one box culvert along the ground until it contacts and/or seals against a second box can often lead to ineffective sealing between the two boxes due for example to the dirt which is disturbed by pushing the box culvert along the ground. It would be advantageous to have a box culvert assembly which generally does not require the boxes to slide along the ground or soil, but also creates a strong contact and/or seal between the boxes.

Thus, in accordance with an embodiment, a box culvert assembly can comprise first and second four-sided concrete boxes coupled to one another, the first and second boxes having first ends, second ends, and openings extending between the first and second ends. The first box can comprise a protruding ledge, the protruding ledge comprising a first portion, a second portion, and a third portion in between the first and second portions, the first and second portions having a greater thickness than the third portion. The second box can comprise a recessed ledge having surfaces for contacting and supporting the first and second portions; and wherein a gap exists between the third portion and the recessed ledge.

In accordance with another embodiment, a method of constructing a box culvert can comprise providing a first box culvert, the first box culvert having a first end comprising a platform having two receiving surfaces located adjacent two corners of the box, the two receiving surfaces being elevated lower than a third surface extending between the two receiving surfaces. The method can further comprise providing a second box culvert, the second box culvert having a second end comprising a protruding lip having first and second lip ends, the first and second lip ends having a greater thickness than that of a remainder of the lip. The method can further comprise lowering the second end of the second box culvert onto the first end of the first box culvert at an angle such that the first and second lip ends contact the two receiving surfaces, and the two receiving surfaces support the second box culvert, and pivoting the second box culvert about the receiving surfaces, such that the first and second ends are joined together.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENT

An improved box culvert assembly 10 is disclosed herein. The embodiments disclosed herein are described in the context of a concrete box culvert assembly comprised of a plurality of concrete boxes for placement under a road because the embodiments disclosed herein have particular utility in this context. However, the embodiments and inventions herein can also be applied to types of boxes, culverts, and/or structures configured for other types of environments, and comprised of materials other than concrete.

Figure 1:
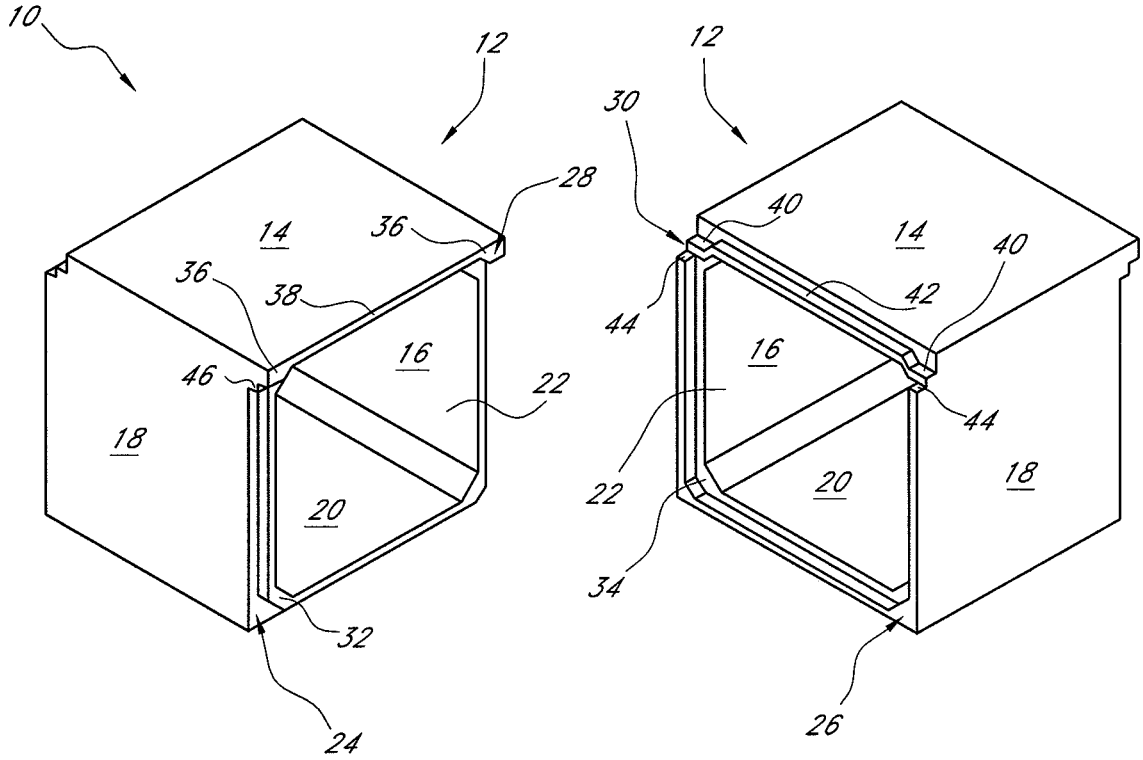
FIG. 1 is a perspective view of two boxes that form a box culvert assembly.

With reference to FIG. 1, a box culvert assembly 10 can comprise at least two boxes 12. Each of the boxes 12 can be formed from concrete or other suitable material, and can have a first wall 14, a second wall 16, a third wall 18, and a fourth wall 20, with the first, second, third, and fourth walls surrounding an opening 22 extending through the box 12. The box 12 can further comprise a front face 24 on one end of the box 12, and a back face 26 on the other end of the box 12, with each of the faces 24, 26 extending generally around the opening 22.

Each box 12 can further comprise a first front side attachment feature 28. The first front side attachment feature 28 can be formed as part of the front face 22. The first front side attachment feature 28 can be used to connect and/or attach a first box 12 to a second box 12 during assembly of a culvert. For example, and as described further herein, the first front side attachment feature 28 can be used to lower and pivot a first box 12 onto a second box 12. In some embodiments, the first front side attachment feature 28 can comprise a protruding ledge (e.g. a tongue) extending generally along an edge of wall 14. The first front side attachment feature 28 can be configured to rest upon and/or seal against at least a portion of a first back side attachment feature 30 of a second box 12.

With continued reference to FIG. 1, the first back side attachment feature 30 can also be used to connect and/or attach a first box 12 to a second box 12 during assembly of a culvert. For example, the first back side attachment feature 30 can be used to lower and pivot a first box 12 onto a second box 12. In a preferred arrangement, the first back side attachment feature 30 can receive and support at least a portion of the first front side attachment feature. The first back side attachment feature 30 can comprise, for example, a recessed ledge, such as for example a groove, formed as part of the back face 26 of box 12 and extending generally along an edge of wall 14.

With continued reference to FIG. 1, the front face 24 can further comprise a second front side attachment feature 32. The second front side attachment feature 32 can be used to connect and/or attach one box 12 to another box 12 during assembly of a culvert. For example, the second front side attachment feature 32 can comprise a peripheral lip protruding from the front face 24 and extending generally along an edge of walls 18, 20, and 16.

The back face 26 can comprise a second back side attachment feature 34. The second back side attachment feature 34 can be used to connect and/or attach one box 12 to another box 12 during assembly of a culvert. For example, the second back side attachment feature 34 can comprise a recessed area 34 extending generally along an edge of walls 18, 20, and 16 for receiving the second front side attachment feature 32.

With continued reference to FIG. 1, the first front side attachment feature 28 can comprise first and second portions 36, and a third portion 38 extending between the first and second portions 36. As illustrated in FIG. 1, the first and second portions 36 can have a greater thickness than the third portion 38. For example, the first and second portions can have a thickness (the thickness having a direction extending in a direction between walls 14 and 20) which is approximately twice that of the thickness of third portion 38. In some embodiments, the first and second portions can have a thickness which is at least twice that of the thickness of the third portion. In some embodiments, the first and second portions can have a thickness which is at least three times that of the thickness of the third portion. In some embodiments, the first and second portions can have a thickness which is at least four times that of the thickness of the third portion. Other ranges are also possible. In some embodiments, the thickness of the first and second portions can be at least 2 inches. In some embodiments, the thickness of the first and second portions can be at least 3 inches. In some embodiments, the thickness of the first and second portions can be at least 4 inches. Other ranges are also possible. In some embodiments, the third portion 38 can comprise a relatively thin protruding ledge of concrete, and the first and second portions, positioned on either end of third portion 38, can comprise relatively thick protruding portions of concrete. In some embodiments, the first, second, and third portions 36, 38 can have the same thickness, forming one protruding lip. In some embodiments, the first and second portions can protrude from corners of the box 12. In some embodiments, the first and second portions can protrude over a recessed area of the front face 24 adjacent the second front side attachment feature 32. In some embodiments, the first and second portions can be configured to support the weight of the box 12.

With continued reference to FIG. 1, the first back side attachment feature can comprise first and second surfaces 40, and a third surface 42 extending between the first and second surfaces 40. As illustrated in FIG. 1, the first and second surfaces 40 can have an elevation (the elevation having a direction extending between walls 14 and 20, with wall 20 being higher than that of wall 14) lower than that of the third surface 42. In other embodiments, the elevations can vary. In some embodiments, the first, second, and third surfaces all have the same elevation, forming a single platform (e.g. all the surfaces can comprise one surface). Additionally, the third surface 42 can generally form part of a relatively thin ledge extending between first and second surfaces 40.

With continued reference to FIG. 1, the back face 26 can further comprise fourth and fifth surfaces 44. The fourth and fifth surfaces 44 can be located adjacent the first and second surfaces 40, and can be elevated lower than the first and second surfaces 40. The fourth and fifth surfaces 44 can be used to receive first and second portions 36 from another box 12. For example, the first and second portions 36 can comprise first and second inner ledges 46 (only one of which is shown in FIG. 1). The first and second inner ledges 46 can be located on either side of third portion 38, and can be configured to rest upon and/or seal against the fourth and fifth surfaces 44 when the two boxes 12 are assembled.

Figure 2A:
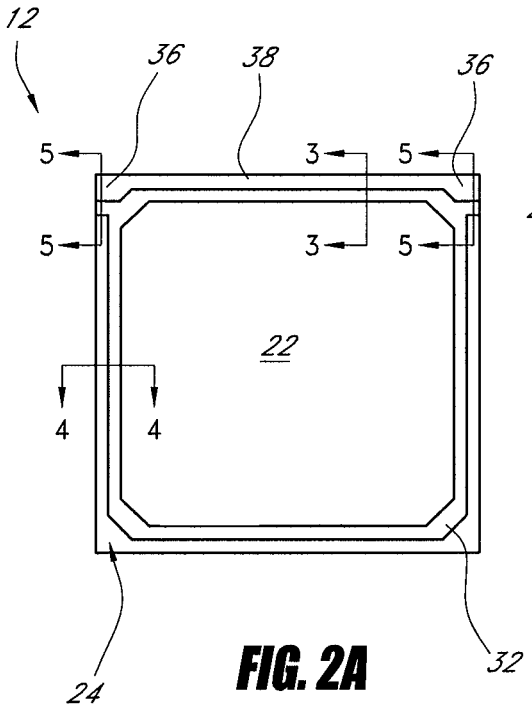
FIG. 2A is a front elevational view of either of the boxes from FIG. 1.
Figure 2B:
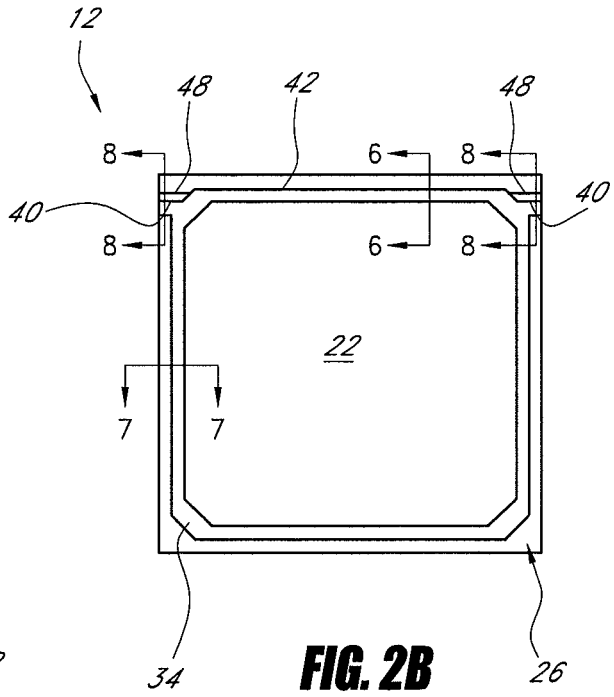
FIG. 2B is a back side elevational view of either of the boxes from FIG. 1.

With reference to FIGS. 2A and 2B, the front face 24 and back face 26 can have a substantially similar appearance when viewed directly head-on. Surfaces and portions of the front face 24 which generally protrude outwardly can have corresponding recessed areas on back face 26, and surfaces and portions on the back face 26 which generally protrude outwardly can have corresponding recessed areas on front face 24. Additionally, the protruding and recessed portions of front face 24 and back face 26 can be angled (e.g. inclined) so as to guide and facilitate connection of corresponding portions on the back face 26 and/or front face 24 of another box 12.

Figure 3:
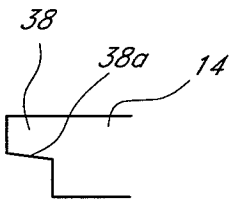
FIG. 3 is a partial cross-sectional view of the box of FIG. 2A, illustrating a thin protruding ledge.
Figure 6:
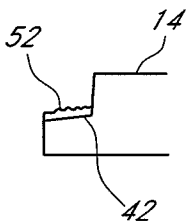
FIG. 6 is a partial cross-sectional view of the box of FIG. 2B, illustrating a recessed ledge and further including some sealant type material along a surface.

For example, and with reference to FIGS. 2A and 3, the third portion 38 of first front side attachment feature 28 can have an angled surface 38*a* facing generally towards the wall 20 of box 12 (e.g. facing towards the bottom of the box 12). With reference to FIGS. 2B and 6, the third surface 42 of first back side attachment feature can be angled and facing generally away from wall 20 of box 12 (e.g. facing towards the top of box 12). When boxes 12 are assembled, the angled surfaces 38*a* and 42 can facilitate ease of assembly. Additionally, and as explained further below, the angled surfaces 38*a* and 42 and/or overall configuration of the third portion 38 and third surface 42 can create a space (e.g. gap) between the third portion 38 and third surface 42 for insertion of sealing fluid or other material.

Figure 4:
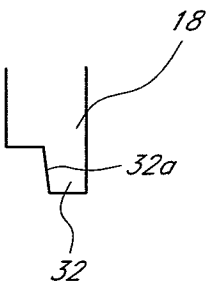
FIG. 4 is a partial cross-sectional view of the box of FIG. 2A, illustrating a lip that extends around at least a portion of the box.
Figure 7:
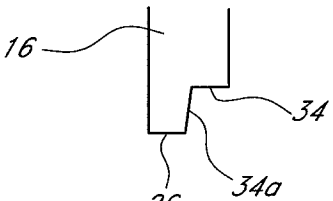
FIG. 7 is a partial cross-sectional view of the box of FIG. 2B, illustrating a recessed area extending around at least a portion of the box.

With reference to FIGS. 2A and 4, the wall 18 can comprise the second front side attachment feature 32, such as for example a lip. The second front side attachment feature 32 can comprise an angled surface 32*a* facing generally away from wall 16 (e.g. facing away from the inside of the box 12). As described above, the second front side attachment feature 32 can extend around walls 18, 20, and 16. With reference to FIGS. 2B and 7, the wall 16 can comprise a recessed area 34. The recessed area 34 can comprise an angled surface 34*a* facing generally towards wall 18 (e.g. facing towards the inside of box 12). When boxes 12 are assembled, the angled surfaces 32*a* and 34*a* can facilitate ease of assembly.

Figure 5:
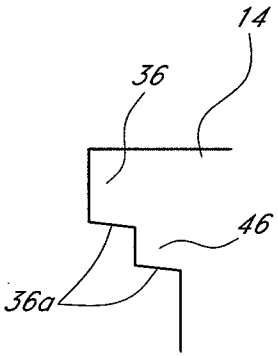
FIG. 5 is a partial cross-sectional view of the box of FIG. 2A, illustrating a thick protruding ledge.
Figure 8:
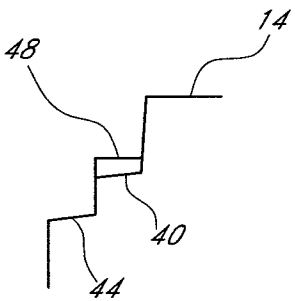
FIG. 8 is a partial cross-sectional view of the box of FIG. 2B, illustrating recessed ledges for receiving a protruding ledge from another box, as well as sealing pads.

With reference to FIGS. 2A and 5, the first and second portions 36 can comprise angled surfaces 36*a* facing generally towards the wall 20 of box 12 (e.g. facing towards the bottom of the box 12). With reference to FIGS. 2B and 8, the first and second surfaces 40 can be angled (e.g. inclined), and can generally face away from wall 20 (e.g. face away from the inside of box 12). The fourth and fifth surfaces 44 can also, or alternatively, be angled, and can generally face away from wall 20 (e.g. face away from the inside of box 12). Thus, when boxes 12 are assembled, the angled surfaces 36*a*, 40, and/or 44 can facilitate ease of assembly.

While the angles (e.g. inclinations) of the surfaces 38*a*, 32*a*, 36*a*, 42, 34*a*, 40, and 44 illustrated in FIGS. 3-8 are shown as being approximately 5 degrees with respect to first wall 14, other angles can also be used, including but not limited to angles greater than or less than 5 degrees. Additionally, the angles can vary from surface to surface. For example, the angle (e.g. inclination) of surface 38*a* can be different from that of surface 42. The angle of surface 38*a* can additionally, or alternatively, be different from that of surface 34*a*.

Figure 9:
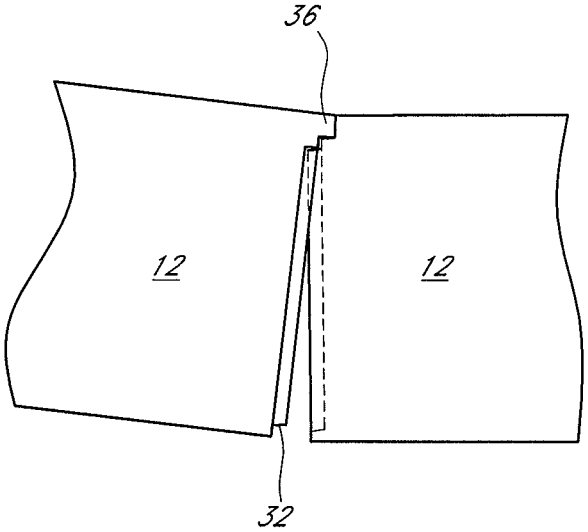
FIG. 9 is a side elevational view of a method of lowering a first box onto a second box and pivoting the first box into place about the second box.
Figure 10:
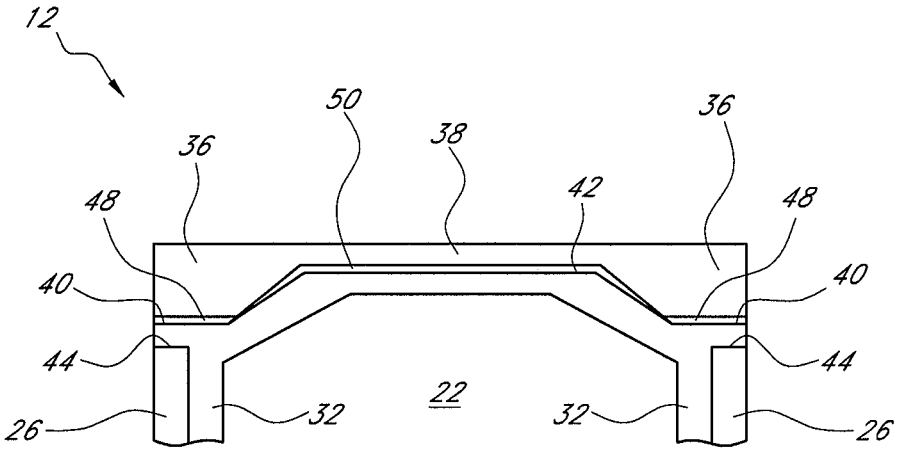
FIG. 10 is a schematic illustration of two boxes connected to one another, including padding and a sealed gap area formed between the two boxes.

With reference to FIGS. 9 and 10, a method for assembling the boxes 12 is shown. As illustrated in FIG. 9, to assemble two of the boxes 12, one of the boxes 12 can first be resting flat on the ground (e.g. the box on the right in FIG. 9). The other box 12 can then be lowered from above, usually by a mechanical device such as a crane, such that portions of the other box 12 contact and pivot about portions of the box 12 already on the ground.

For example, a box 12 can be lowered until the first and second portions 36 of the box 12 are resting upon the first and second surfaces 40 of the box 12 already on the ground. The crane can be supporting a portion of the weight of the box 12 as it is lowered into place and placed into contact with the box 12 already on the ground. Once contact is made, the lowered box 12 can swing into the box 12 already on the ground, such that the second front side attachment feature 32 fits into the recessed area 34, and the second inner ledges 46 rest on the fourth and fifth surfaces 44. In some embodiments, the first and third portions 36, 38 can support at least ⅓ of the weight of the box 12 as it is being lowered into place on first and second surfaces 40. In some embodiments, the first and third portions 36, 38 can support at least ½ of the weight of box 12 as it is being lowered into place on first and second surfaces 40. In some embodiments, the first and third portions 36, 38 can support at least ⅓ of the weight of the box 12 as it is being lowered into place on both the first and second surfaces 40 and the fourth and fifth surfaces 44. In some embodiments, the first and third portions 36, 38 can support at least ½ of the weight of box 12 as it is being lowered into place on both the first and second surfaces 40 and the fourth and fifth surfaces 44. Other ranges of weight support are also possible.

Because the first and second portions 36 are relatively thick compared to both third portion 38 and the thin ledge comprising surface 42, and because first and second surfaces 40 are positioned near corners of the box 12 already on the ground, the weight of other box 12 is easily supported by the two contact points or areas near the corners of the boxes 12. If the weight of the other box 12 were to be lowered onto the surface 42, the ledge comprising surface 42 may likely break or fracture. Similarly, the third portion 38 may break or fracture. Thus, providing relatively thick first and second portions 36, along with recessed receiving areas 40 near the corners of the box 12, can facilitate assembly of the two boxes 12 without undesired stress or fracture.

Additionally, and with reference to FIGS. 8 and 10, sealing pads 48 or other similar devices can be used to facilitate assembly of the boxes 12 and/or form a seal between the boxes 12. For example, a sealing pad 48 can be placed and/or attached onto first and second portions 36 or first and second surfaces 40. The sealing pads 48 can be used to cushion and/or absorb the contact between the first and second portions 36 while one box 12 is being lowered and pivoted about another box 12. The sealing pad 48 can remain, in a compressed state, between the two boxes after they have been assembled, as shown in FIG. 10.

With continued reference to FIGS. 9 and 10, by using the first and second portions 36 and surfaces 40 to create initial contact and pivot points between boxes 12, an area (e.g. gap) between the third portion 38 and surface 42 can be created and/or used. Similarly, by using sealing pads 48, an area (e.g. gap) between the third portion 38 and surface 42 can be created and/or used. For example, and as illustrated in FIG. 10, a gap 50 can be created between the third portion 38 and surface 42. Prior to assembly of the boxes, a sealant 52 (e.g. a type of adhesive, or any other type of sealant), such as shown in FIG. 6, can be spread across surface 42. When the boxes are assembled, and pivoted into place on top of first and second surface 40 and sealing pads 48, the sealant can be pressed and fill at least part of the gap 50 shown in FIG. 10, thereby facilitating a strong, generally leak-free attachment between the two boxes. In some embodiments, the gap 50 can be bordered at least in part by the sealing pads 48.

While the sealant 52 can be used in gap 50, it is understood that sealant could be used elsewhere. For example, sealant could be used between the angled surfaces 32*a* and 34*a* along the walls 18, 20, and 16 of the boxes 12, and/or between the angled surfaces 36*a* and 44. In some embodiments, no sealant can be used, and gap 50 can remain open. In some embodiments, no sealant can be used, and gap 50 does not exist. Rather, the third portion 32 can contact (e.g. but not press with significant force) against the surface 42 when the boxes 12 are assembled.

In yet other embodiments, sealing pads 48 can be placed elsewhere, or not used at all. For example, in some embodiments, no sealing pads 48 can be used. Instead, the first and second portions 36 can directly contact the first and second surfaces 44. In other embodiments, sealing pads 48 can be used on the other two corners (e.g. the bottom two corners) of the boxes in addition to or alternatively from using sealing pads 48 as shown in FIG. 10.

In yet other embodiments, the first, second, and third surfaces 40 and 42 can all generally have the same elevation (i.e. can be coplanar). Thus, in such an embodiment, the gap 50 can be significantly larger than that shown in FIG. 10. Other sizes, shapes, and configurations for the gap 50 other than that shown are also possible.

As described above, the assembly 10 allows the boxes to be placed together and/or sealed without sliding the boxes along the ground. This advantageously inhibits the accumulation of dirt, debris, or other matter which may cause premature deterioration or inefficient use of the culvert.

Additionally, the boxes 12 can be pivoted about two points or areas which are stable, and can fully support the load of a concrete box 12. This advantageously permits the boxes 12 to be assembled without undesired stress and/or fracture. This arrangement also advantageously allows the boxes to be sealed together, and/or formed tightly together, simply by lowering one box down next to another and allowing gravity to pivot one box into another. Such ease of assembly reduces the effort involved in assembling a large culvert.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A box culvert assembly comprising:

first and second four-sided concrete boxes coupled to one another, the first and second boxes having first ends, second ends, and openings extending between the first and second ends;

the first box comprising an upper protruding ledge, the protruding ledge having a distal most end comprising a first portion, a second portion, and a third portion in between the first and second portions, the first and second portions having a greater thickness than the third portion, the first and second portions of the distal most end of the protruding ledge being configured to support at least a portion of the weight of the first box when the first box is coupled to the second box, said first portion located at a first corner of the first box and said second portion located at a second corner of the first box; and the second box comprising a recessed ledge having a first receiving surface located adjacent to a top edge and a first side of the box and a second receiving surface located adjacent to the top edge and a second side of the box for contacting and supporting the first and second portions of the distal most end of the protruding ledge.

2. The box culvert assembly of claim 1, wherein the first and second portions protrude from the first box over a recessed area along a front face of the first box.

3. The box culvert assembly of claim 1, wherein the first and second portions are at least twice as thick as the third portion.

4. The box culvert assembly of claim 1, wherein the first and second portions are at least 3 inches thick.

5. The box culvert assembly of claim 1, further comprising sealing pads attached to the surfaces of the recessed ledge.

6. The box culvert assembly of claim 1, wherein a gap exists between the third portion and the recessed ledge.

7. The box culvert assembly of claim 6, wherein a sealant fills at least a portion of the gap.

8. The box culvert assembly of claim 7, wherein the gap is bordered at least in part by sealing pads.

9. The box culvert assembly of claim 1, wherein the first box is fully supported by the surfaces for contacting and supporting the first and second portions.

* * * * *